US005114152A

United States Patent [19]

Rouse et al.

[11] Patent Number: 5,114,152

[45] Date of Patent: May 19, 1992

[54] AUTOMOTIVE RACING GAME

[76] Inventors: Jessie L. Rouse; Jesse L. Rouse, both of 703 Orange St., Elgin, Ill. 60123

[21] Appl. No.: 670,180

[22] Filed: Mar. 15, 1991

[51] Int. Cl.[5] ..... A63F 3/00

[52] U.S. Cl. ..... 273/246

[58] Field of Search ..... 273/243, 246, 248, 249

[56] References Cited

U.S. PATENT DOCUMENTS

| | | | |
|---|---|---|---|
| 1,493,738 | 5/1924 | Cowan | 273/246 |
| 1,628,073 | 5/1927 | Sousa | 273/246 |
| 1,993,679 | 3/1935 | Mosse | 273/246 |
| 3,768,812 | 10/1973 | Basa | 273/246 |
| 3,883,143 | 5/1975 | Kelley | 273/246 |
| 4,062,545 | 12/1977 | Witney | 273/246 X |
| 4,082,289 | 4/1978 | Merritt | 273/246 |
| 4,264,076 | 4/1981 | Duncan | 273/246 |
| 4,288,077 | 9/1981 | Rose | 273/246 |
| 4,357,017 | 11/1982 | Schneider | 273/246 |
| 4,729,568 | 3/1988 | Welsh | 273/246 |

*Primary Examiner*—Edward M. Coven
*Assistant Examiner*—William E. Stoll
*Attorney, Agent, or Firm*—Leon Gilden

[57] ABSTRACT

A board game apparatus includes a playing board including a series of contiguous and continuous tracks, each of the tracks defined by spaces of varying lengths, wherein tokens directed throughout the tracks may switch lanes to gain access to varyingly length spaces to advance about the tracks. Calculator and score indicators are utilized, with each token's designated starting position throughout the track. The predetermined number of tracks include a further predetermined number of tokens, wherein at least twice the tokens are utilized as the predetermined number of tracks.

2 Claims, 6 Drawing Sheets

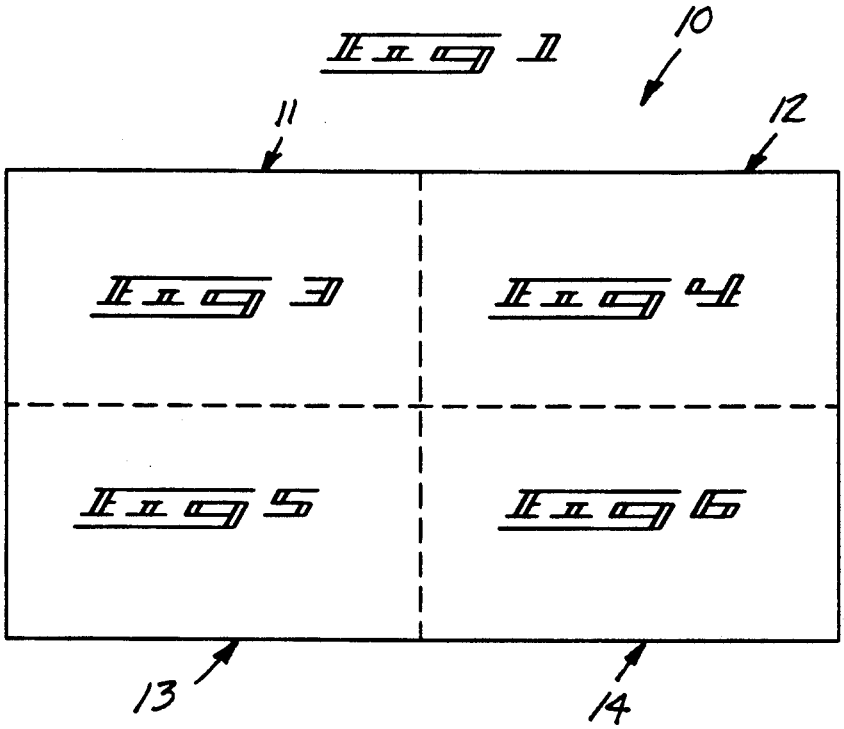
Fig 2
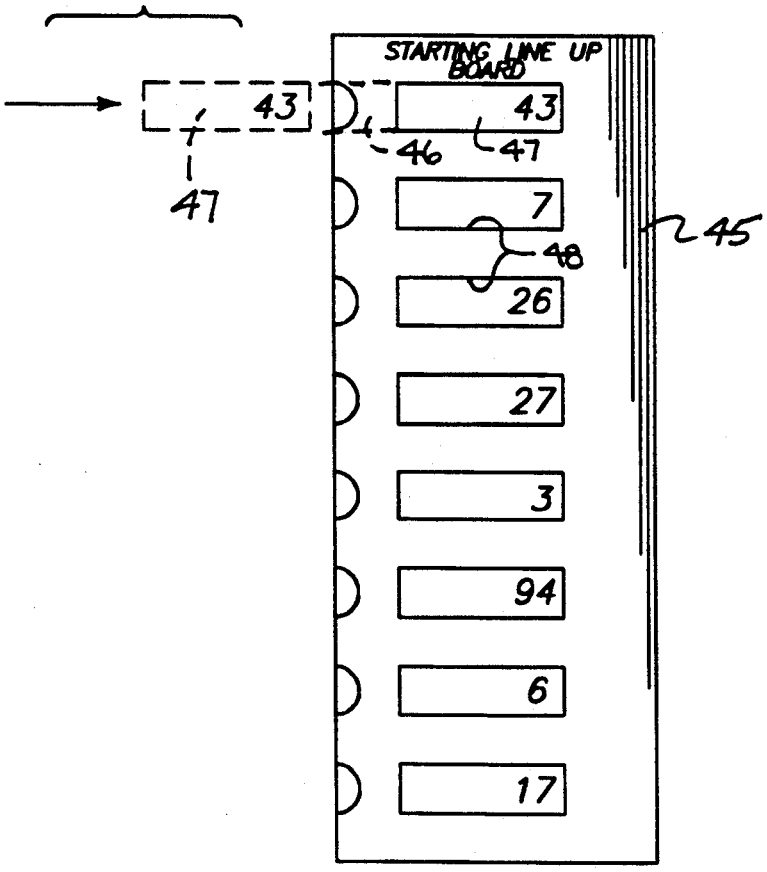

AUTOMOTIVE RACING GAME

BACKGROUND OF THE INVENTION

1. Field of the Invention

The field of invention relates to board game apparatus, and more particularly pertains to a new and improved automotive racing game wherein the same is arranged for simulating automotive racing.

2. Description of the Prior Art

Various board games have been utilized in the prior art for simulating racing events. Such apparatus may be found in U.S. Pat. No. 4,624,463 to Glennon wherein a board game is arranged for simulating racing utilizing penalty and award spaces in association with a dice pair.

U.S. Pat. No. 4,729,568 to Welsh sets forth a horse racing board game for simulating horse racing events.

U.S. Pat. No. 4,010,956 to Zyla, et al. sets forth a simulation of automotive drag racing incorporating dice for simulating a racing event in a linear direction along a board.

U.S. Pat. No. 4,881,740 to Odhner sets forth a board game for simulating racing intersecting and overlapping paths from start to finish.

U.S. Pat. No. 4,357,017 to Schmider, et al. sets forth an auto racing type game utilizing player actuated disks for determining race car movement when the disks are directed onto indicia board for indicating a number of spaces to be moved by a respective token.

As such, it may be appreciated that there continues to be a need for a new and improved automotive racing game as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of racing board games now present in the prior art, the present invention provides an automotive racing game wherein the same is arranged for simulating automotive racing along continuous paths permitting repositioning of various tokens from one path to another to effect completion of the racing event. As such, the general purpose of the present invention, which will be described subsequently in greater detail, is to provide a new and improved automotive racing game which has all the advantages of the prior art racing board games and none of the disadvantages.

To attain this, the present invention provides a board game apparatus including a playing board with a series of contiguous and continuous tracks, each of the tracks defined by spaces of varying lengths, wherein tokens directed throughout the tracks may switch spaces to gain access to varyingly length spaces to advance about the tracks. Calculator and score indicator organizations are utilized, with qualification of each token designating starting position throughout the track. The predetermined number of tracks include a further predetermined number of tokens, wherein at least twice the tokens are utilized as the predetermined number of tracks.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved automotive racing game which has all the advantages of the prior art racing board games and none of the disadvantages.

It is another object of the present invention to provide a new and improved automotive racing game which may be easily and efficiently manufactured and marketed.

It is a further object of the present invention to provide a new and improved automotive racing game which is of a durable and reliable construction.

An even further object of the present invention is to provide a new and improved automotive racing game which is susceptible of a low cost of manufacture with regard to both materials and labor, and which accordingly is then susceptible of low prices of sale to the consuming public, thereby making such automotive racing games economically available to the buying public.

Still yet another object of the present invention is to provide a new and improved automotive racing game which provides in the apparatuses and methods of the prior art some of the advantages thereof, while simultaneously overcoming some of the disadvantages normally associated therewith.

Still another object of the present invention is to provide a new and improved automotive racing game wherein the same is arranged for effecting simulation of vehicular racing employing repositioning of the tokens along contiguous paths of travel.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration given to the following detailed description thereof. Such description makes reference to the annexed drawings wherein:

FIG. 1 is an orthographic plan view of the game board configuration utilized by the instant invention.

FIG. 3 is an orthographic plan view of FIG. 3 as set forth in FIG. 1.

DESCRIPTION OF THE PREFERRED EMBODIMENT

Figure 2:
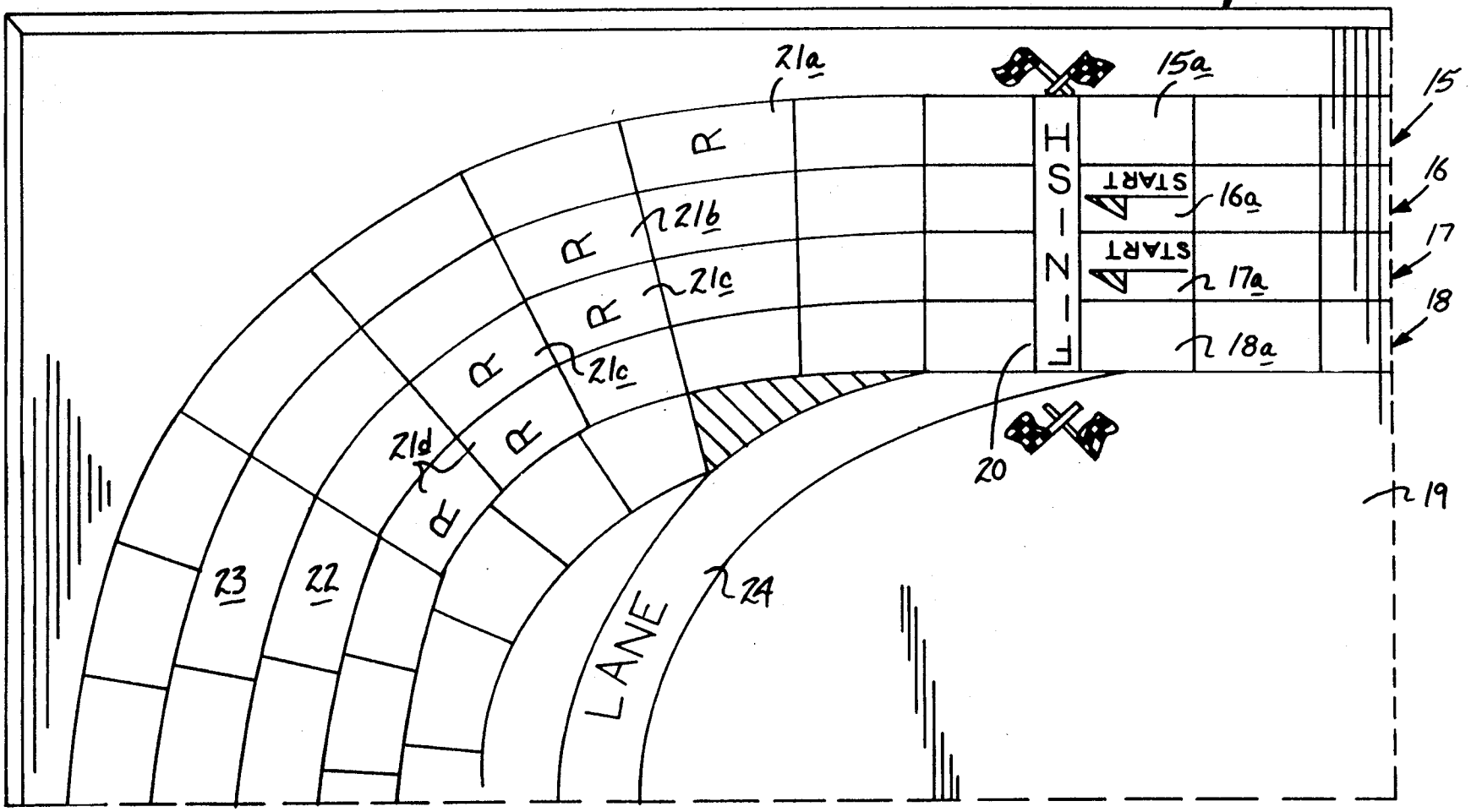
FIG. 2 is a top plan view of the positioning card as utilized by the instant invention.
Figure 4:
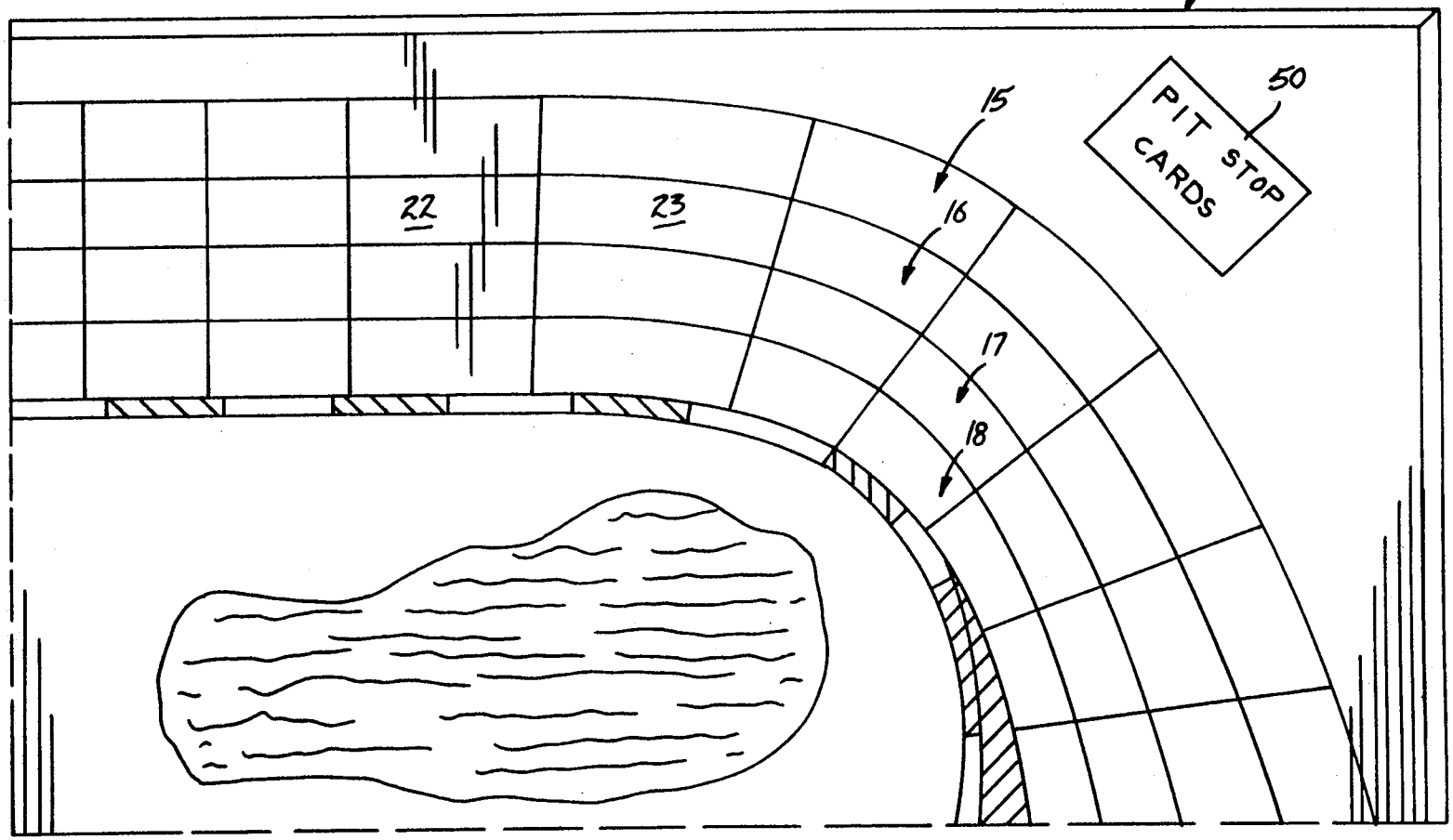
FIG. 4 is an orthographic plan view of FIG. 4 as set forth in FIG. 1.
Figure 5:
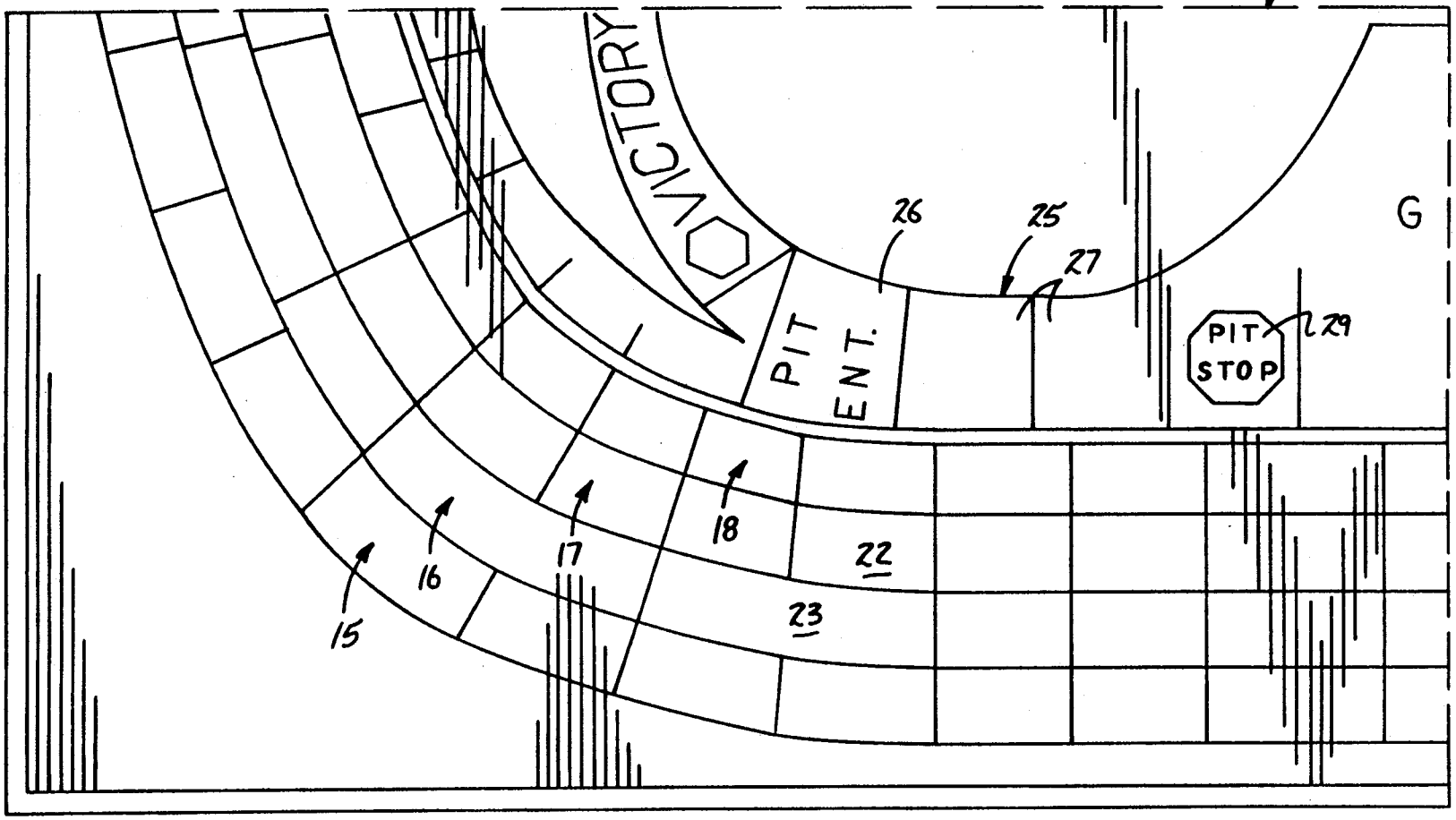
FIG. 5 is an orthographic plan view of FIG. 5 as set forth in FIG. 1.
Figure 6:
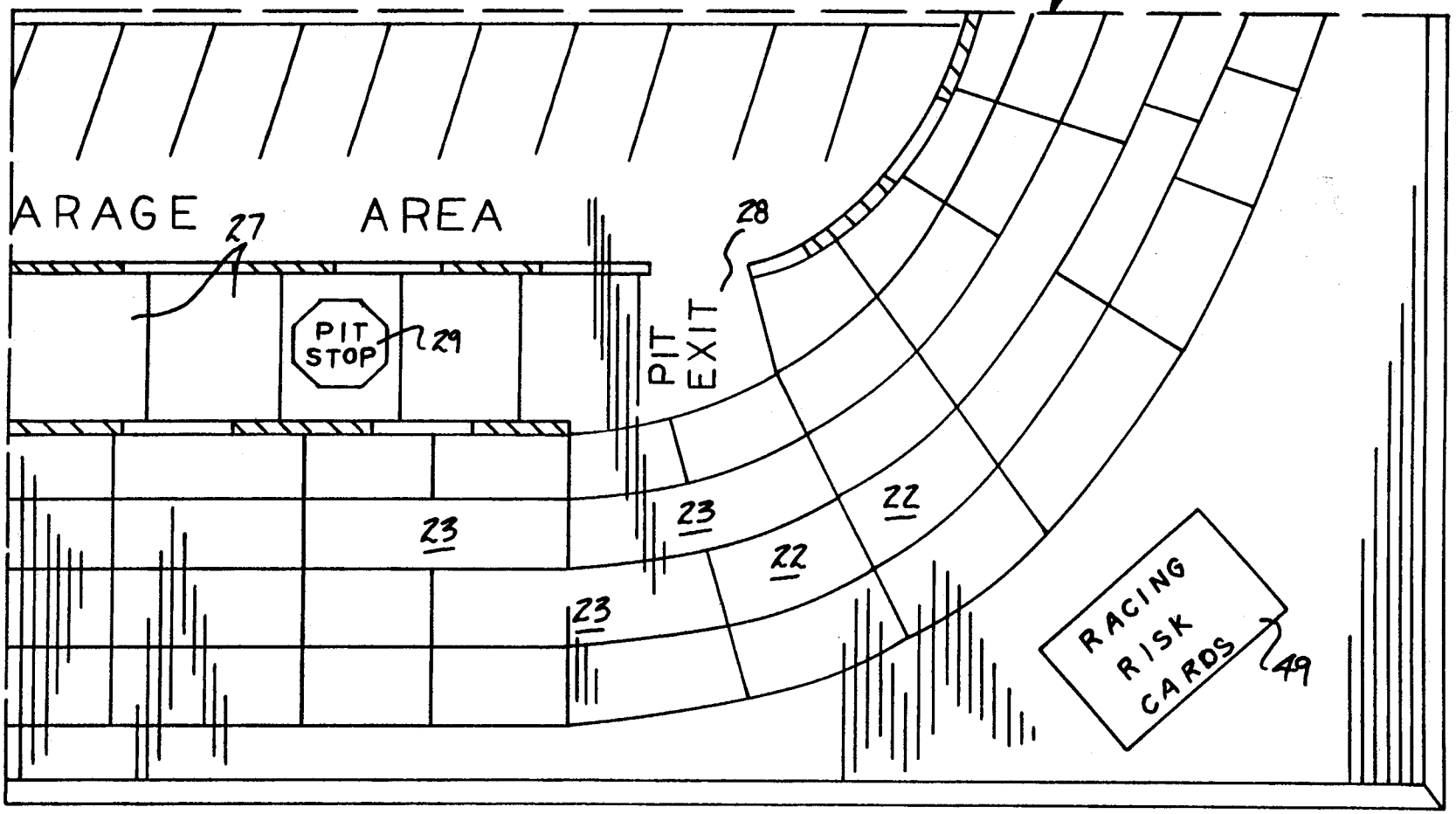
FIG. 6 is an orthographic plan view of FIG. 6 as set forth in FIG. 1.
Figure 7:
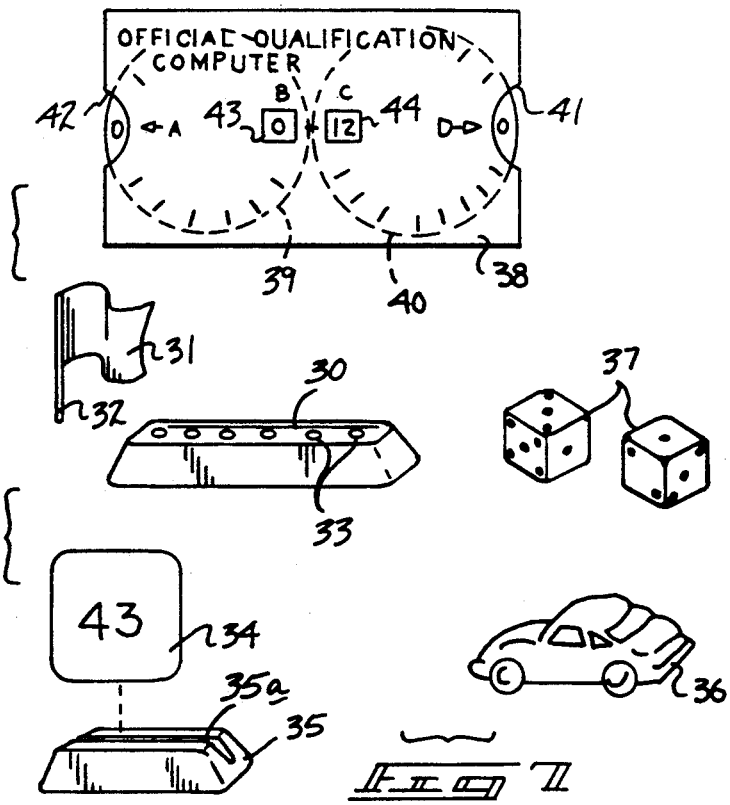
FIG. 7 is an isometric illustration of various components utilized by the instant invention in play of the game.
Figure 8:
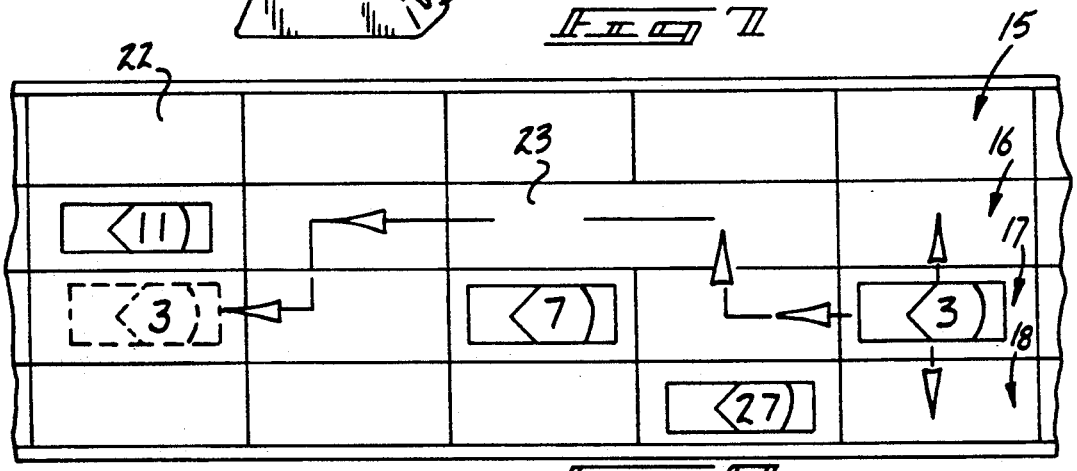
FIG. 8 is an orthographic plan view of an enlarged portion of the game board for illustrating repositioning of tokens along the paths of travel.
Figure 9:
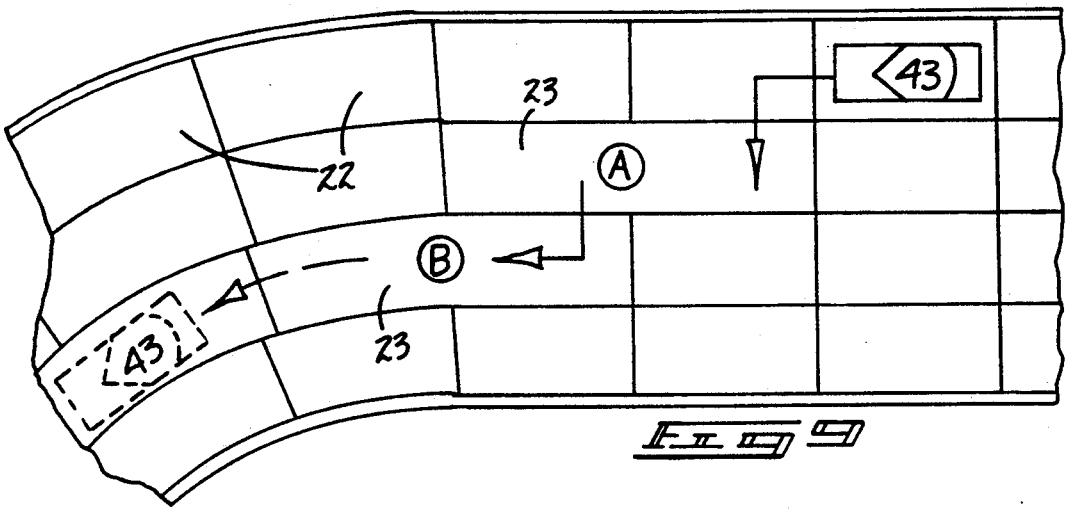
FIG. 9 is an orthographic plan view setting forth a further example of travel along the paths of travel of the game board.

With reference now to the drawings, and in particular to FIGS. 1 to 9 thereof, a new and improved automotive racing game embodying the principles and concepts of the present invention and generally designated by the reference numeral 10 will be described.

More specifically, the automotive racing game of the instant invention essentially comprises a game board, as set forth in FIG. 1, defined by a respective first, second, third, and fourth board quadrant 11, 12, 13, and 14 respectively, as depicted through FIGS. 3–6 respectively. The game board is defined by respective first, second, third, and fourth continuous paths 15, 16, 17, and 18 respectively that are directed about the game board in contiguous relationship relative to one another. The paths are each initiated as respective first, second, third, and fourth starting space 15*a*, 16*a*, 17*a*, and 18*a* respectively, as illustrated in FIG. 3. A single continuous finish line space 20 must be crossed by each participant subsequent to six crossings of the game board by a combination of one or all of the continuous paths. The paths are defined by spaces of varying lengths to include a first and second length 22 and 23, as illustrated in FIGS. 3–6. A plurality of such varying path lengths are directed throughout each of the continuous paths 15–18 to provide advantageous positioning of the various tokens 36 as they are directed about the game board. In this manner, individuals may be repositioned from one path to the next to gain in their traverse of the game board. A central infield area 19 is defined by the game board. A victory lane 24 is in communication with the single finish line space 20, wherein each token of each respective player as it finishes a predetermined number of laps, such as six laps, is directed along the finish line space 20 into the victory lane space 24 that projects into the infield 16, wherein the tokens are therefore aligned in accordance to their finishing of the finish line space 20. Various racing risk cards are provided and are picked by a player should a player make a move for the game board on one of the "R" spaces 21*a*, 21*b*, 21*c*, and 21*d* respectively directed through the respective four continuous paths. A pit stop path 25 is positioned in contiguous relationship with the fourth continuous path 18, including a pit stop entrance space 26, with a series of pit stop path spaces 27 directed along the fourth continuous path 18 that includes a plurality of pit stop spaces 29. Should the player make a move on the pit stop space 29, a card from the grouping of pit stop cards 50 is selected by that player. The risk and pit stop cards 49 and 50 respectively are divided into various categories of "advantages", "disadvantages", and "suggestions". These cards direct individuals to advance, retreat, loose turns, and the like in the path of travel or provide suggestions to enhance advantage in traverse of the various paths and are accordingly categorized as "suggestion cards". For example should a suggestion card direct a player to change paths, the player may thusly do so for that player's advantage or disadvantage as required by the respective card.

Each player at the outset of each game is awarded a respective enumerated "pit row" identification card 34 that is mounted within a support block 35 including a groove 35*a* to receive the card 34 therewithin. Each player may not traverse the paths 15–18 more than four times prior to a player requiring entrance into the pit stop path 25 for "refueling". Upon the player and associated token 36 directed into the pit stop path 25, that player identification card 34 is presented as having met the requirement of the game for the required stop. Dice 37 are utilized as a chance mechanism to direct players along the paths. The players may travel forwardly and laterally to avoid opposing players and their tokens. It should be noted that at least eight tokens 36 are utilized to accommodate eight players, wherein at least twice the number of tokens are utilized as there are paths of travel to provide at least a plurality of rows at the outset of the game to simulate associated traffic and the like encountered in conventional automotive racing.

A calculator 38 is utilized to determine positioning of each player at the outset of the game from a pole position that is provided by the position 18*a* in the start position to a remaining position positioned adjacent rearwardly of the start position 15*a* of the first path of travel 15. The calculator 38 includes a respective first and second counter wheel 39 and 40 rotatably mounted within the calculator body, with a first notch 41 and second notch 42 effecting viewing upon each calculator wheel at the side edges of the body of the calculator, with a first and second window 43 and 44 viewing diametrically opposed digits within the calculator. The digits are directed in sequential order about each counter wheel. Additionally, the computer is positioned until each of the first and second wheel notches 41 and 42 indicate a zero. A player will throw the dice 37 while that player is directed through a qualification lap about a respective path of travel 15–18. The player will throw the dice until he returns the car to a starting space. Each player will sequentially stop his car on the starting space and through the aforenoted trial qualification lap. Each time a player throws a dice, the number of turns that player has required to use in effecting a single qualification lap is illustrated in the window 43, and totals remaining subsequent to a completed lap are illustrated in the second window 44 and are thusly effected by rotating the second wheel 40 to display remaining points in the second window 44. For example, if the first window 43 displays the number 5, and the window 44 displays the number 7, then that player's qualification is five hop-seven. Each player must remain in the same path until that qualification lap has been completed. The second window 44 illustrates the number of points remaining when that player has completed the lap that is indicated on the dice. The player with the lowest total will be awarded the "pole" position or the starting space 18*a* and directed along the first row of spaces 18*a*, 17*a*, 16*a*, and 15*a* respectively. The remaining four players will be positioned in order of their point total behind the spaces 18*a*, 17*a*, 16*a*, and 15*a* respectively. For example, totals such as five-five, five-nine, six-two, six-eight, and the like would in that order direct players to the spaces 18*a*–15*a* respectively. Should two players qualify with the same score, those players must complete and additional lap to effect a tie breaker.

Should there be less than eight players available, players available will select a number of tokens 36 to completely utilize the eight tokens.

FIG. 2 illustrates the use of a position indicator card 45 that includes a series of parallel receiving slots 46. Each receiving slot 46 includes an enumeration indicator card 47 directed within each of the slots, with each indicator card 47 illustrating a digited number awarded arbitrarily to each player. That player may also place that player's name upon each respective card 47.

Movement about the game board is always laterally or in a counter-clockwise direction. The only time when a token may move rearwardly is when required to do so by a risk card 49. The number of spaces that player may advance requires control by that player throwing the dice 37. A player may move his or her car laterally from one space to another or forwardly if that space is long enough to accommodate the length of the car. In the course of a single turn, a player may not pass over a space twice. The token cars may not be moved over any of the spaces of each path occupied by another car type token. Accordingly, only one vehicle may occupy a single space at a single time. If a token gets blocked in and may not move on the paths 15–18, the pit stop path 25, or the victory lane 24 and may not therefore move the spaces indicated on the dice, the player may move forwardly, laterally, or a combination as much as possible. The player may then move onto a space occupied by a vehicle in front of him. That vehicle token is then pushed forwardly one space. If a vehicle is occupying that space, it will also be pushed forwardly.

If a vehicle token 36 is directed by a risk card 49 or having completed four laps to effect a pit stop in the path 25, and may not enter that path, that player must circumvent the board about the paths by throwing only one die of the die pair 37 until that player has positioned to enter the pit stop path 25.

DRAFTING

In the course of a player's turn ending, wherein the last forward space that player wishes to occupy is already occupied by another token 36, the moving player may displace the forwardly positioned token one space by "drafting". This is effected only when approaching another token from rearwardly thereof and the moving player has moved the full number of spaces on the dice to permit forward positioning of each token.

Initially, each token 36 is associated therewith a predetermined number of scoring flags 31 that are receivable within an associated scoring block 30. Each flag 31 includes a flag shaft 32 that is receivable within an associated block aperture 33. Each block includes six apertures, wherein they are provided four green flags and one white flag for use of the four green flags to the first four laps and the white flag in the fifth lap. A first player and associated token 36 to complete the sixth lap is directed through the finish line space 20 into the associated victory lane 24 is awarded a checkered flag and accordingly the winner player is provided with six flags.

As noted above, a player may not proceed more than four laps about an associated path of travel 15–18 without being directed through the pit stop path 25. Upon a player terminating the move upon a pit stop space 29, that player must select a pit stop card 50 to direct a player to effect movement to an advantage or disadvantage of that player.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automotive racing game comprising, in combination, a game board, the game board including a top surface, wherein the top surface includes a predetermined number of contiguous paths, each path is arranged in contiguous relationship relative to an adjacent path, and each path including a plurality of spaces of varying lengths, and each path including a respective starting space, wherein each starting space is aligned relative to one another to define a single row, and a plurality of tokens, wherein the tokens are provided by a further predetermined number, wherein the further predetermined number is twice the predetermined number defined by the predetermined number of paths, and the game board including a single finish space positioned as a single row adjacent the staring spaces, and the finish space contiguous to and adjacent a victory lane space, the game board including an infield area positioned interiorly of the predetermined number of paths, and the victory lane path projecting into the infield from the finish line space to receive the tokens sequentially upon completion of each respective token about the plurality of paths, and a plurality of dice to effect movement of the tokens about the predetermined number of paths, and further including a pit stop path directed from one of said predetermined paths directed into the infield area, wherein the pit stop path includes a predetermined number of pit stop path spaces, and the pit stop path spaces including a plurality of pit stop spaces, and a deck of pit stop cards in association with the pit stop spaces, whereupon a token directed upon a pit stop path is directed to select a pit stop card to effect information for that respective token for movement about the game board, and wherein each of the plurality of paths include a plurality of risk spaces, and each of the risk spaces is associated with a deck of risk cards, whereupon a player being directed upon a risk space selects a risk card to instruct that respective player to position the player's token to an advantage or disadvantage about the game board, and wherein each token has associated therewith an identification card, whereupon a player entering the pit stop path returns a pit row identification card, and each pit row identification includes a support block, and each support block includes a groove, wherein the groove complementarily receives the pit row identification card, and wherein each token has associated therewith a plurality of scoring flags, and each scoring flag includes a scoring flag shaft, and the plurality of scoring flags includes a scoring flag support block, the scoring flag support block includes a plurality of apertures, wherein each aperture receives an associated scoring flag shaft, and each player positions a scoring flag shaft within an associated aperture on completion of a single traverse of the game board, and further including a calculator member, wherein the calculator member includes respective first and second counter wheels, each counter wheel includes a successive plurality of digits, and the first and second scoring wheels include a respective first and second notch positioned in opposed sides of the calculator to permit visual observation of the periphery of each scoring wheel, and the calculator includes a respective first and second window positioned diametrically opposed to the first and second notch to permit visualization of a further digit to effect counting of a predetermined number of dice rolls of the plurality of dice to determine initial positioning of each token upon the respective plurality of paths.

2. A game as set forth in claim 1 including a position indicator card, the position indicator card includes a plurality of parallel slots arranged in a single column, wherein the parallel slots each slidably receive an associated indicator card therewithin, the plurality of slots equal to the further predetermined number of tokens to slidably receive a respective indicator card in the column of slots for indication of descending order of sequential turns of each token in traverse of the game board along the predetermined number of paths.

* * * * *